US011339356B2

(12) United States Patent
Smets et al.

(10) Patent No.: US 11,339,356 B2
(45) Date of Patent: May 24, 2022

(54) LIQUID FABRIC TREATMENT COMPOSITIONS COMPRISING BRIGHTENER

(71) Applicant: The Procter & Gamble Company, Cincinnati, OH (US)

(72) Inventors: Johan Smets, Lubbeek (BE); Conny Erna Alice Joos, Buggenhout (BE); Pascale Claire Annick Vansteenwinckel, Weerde (BE)

(73) Assignee: The Procter & Gamble Company, Cincinnati, OH (US)

( * ) Notice: Subject to any disclaimer, the term of this patent is extended or adjusted under 35 U.S.C. 154(b) by 8 days.

(21) Appl. No.: 16/535,105

(22) Filed: Aug. 8, 2019

(65) Prior Publication Data

US 2020/0056123 A1 Feb. 20, 2020

(30) Foreign Application Priority Data

Aug. 14, 2018 (EP) ..... 18189054

(51) Int. Cl.

| | |
|---|---|
| ***C11D 1/62*** | (2006.01) |
| ***C11D 3/50*** | (2006.01) |
| ***C11D 3/42*** | (2006.01) |
| ***C11D 3/00*** | (2006.01) |
| ***C11D 3/30*** | (2006.01) |
| ***C11D 3/37*** | (2006.01) |
| ***C11D 11/00*** | (2006.01) |
| ***C11D 17/00*** | (2006.01) |
| ***C11D 17/04*** | (2006.01) |
| ***C11D 3/34*** | (2006.01) |
| ***C11D 1/00*** | (2006.01) |
| ***C11D 3/28*** | (2006.01) |

(52) U.S. Cl.

CPC ..... *C11D 3/42* (2013.01); *C11D 1/00* (2013.01); *C11D 3/001* (2013.01); *C11D 3/0015* (2013.01); *C11D 3/28* (2013.01); *C11D 3/30* (2013.01); *C11D 3/34* (2013.01); *C11D 3/3703* (2013.01); *C11D 3/3753* (2013.01); *C11D 11/0017* (2013.01); *C11D 17/0039* (2013.01); *C11D 17/042* (2013.01)

(58) Field of Classification Search

CPC .... C11D 1/00; C11D 3/28; C11D 3/34; C11D 3/42; C11D 17/042; C11D 3/30; C11D 3/001

USPC ..... 510/325, 356, 394, 492, 500, 504, 515

See application file for complete search history.

(56) References Cited

U.S. PATENT DOCUMENTS

| | | | | |
|---|---|---|---|---|
| 4,244,836 | A * | 1/1981 | Frensch | A01N 25/28 264/4.6 |
| 6,194,375 | B1 * | 2/2001 | Ness | A01N 25/10 424/451 |
| 6,488,917 | B2 | 12/2002 | Chevalier et al. | |
| 9,074,305 | B2 | 7/2015 | Glenn, Jr. et al. | |
| 9,644,174 | B2 | 5/2017 | Miravet Celades | |
| 9,951,300 | B2 | 4/2018 | Liu et al. | |
| 2008/0206830 | A1 | 8/2008 | Becker et al. | |
| 2008/0305982 | A1 | 12/2008 | Smets | |
| 2012/0028874 | A1 * | 2/2012 | Fernandez Prieto | C11D 11/0088 510/375 |
| 2013/0303427 | A1 | 11/2013 | Fernandez Prieto et al. | |
| 2014/0342972 | A1 | 11/2014 | Smets | |
| 2016/0090555 | A1 * | 3/2016 | Frankenbach | A61K 8/4926 424/76.1 |
| 2016/0319228 | A1 | 11/2016 | Lant | |
| 2017/0130172 | A1 * | 5/2017 | Smets | C09B 67/0097 |
| 2017/0175058 | A1 * | 6/2017 | Depoot | C11D 17/0039 |
| 2017/0189283 | A1 | 7/2017 | Sasaki | |
| 2017/0211018 | A1 * | 7/2017 | Dykstra | C11D 3/3796 |
| 2017/0211019 | A1 * | 7/2017 | Sivik | C11D 3/3749 |
| 2017/0216166 | A1 | 8/2017 | Sasaki et al. | |
| 2017/0273877 | A1 | 9/2017 | Sasaki | |
| 2017/0298308 | A1 * | 10/2017 | Labeque | B65D 75/30 |
| 2018/0178183 | A1 | 6/2018 | Berthier | |
| 2018/0265816 | A1 * | 9/2018 | Lintula | C11D 17/0039 |
| 2018/0265818 | A1 * | 9/2018 | Smets | C11D 3/505 |
| 2018/0265823 | A1 | 9/2018 | Song | |
| 2018/0265824 | A1 | 9/2018 | Song | |
| 2018/0265826 | A1 | 9/2018 | Song | |
| 2018/0362892 | A1 * | 12/2018 | Beckholt | C11D 3/505 |
| 2020/0056120 | A1 | 2/2020 | Smets | |
| 2020/0056126 | A1 | 2/2020 | Smets | |
| 2020/0063069 | A1 | 2/2020 | Randall et al. | |

FOREIGN PATENT DOCUMENTS

| | | | |
|---|---|---|---|
| JP | 2004300660 | A | 10/2004 |
| JP | 2009525414 | A | 7/2009 |
| JP | 2014125685 | A | 7/2014 |
| JP | 2017172097 | A | 9/2017 |
| WO | 2013188331 | A1 | 12/2013 |
| WO | 2015031418 | A1 | 3/2015 |
| WO | 2017004343 | A1 | 1/2017 |

OTHER PUBLICATIONS

U.S. Appl. No. 16/535,101, filed Aug. 8, 2019, Smets, et al.
U.S. Appl. No. 16/535,103, filed Aug. 8, 2019, Smets, et al.
Extended European Search Report; Application No. 18189054.2-1106; dated Apr. 3, 2019; 6 pages.
Extended European Search Report; Application No. 18189055.9-1106; dated Apr. 3, 2019; 7 pages.

(Continued)

*Primary Examiner* — Gregory R Delcotto

(74) *Attorney, Agent, or Firm* — Gregory S. Darley-Emerson

(57) ABSTRACT

Liquid fabric treatment compositions that include benefit agent capsules, brightener, and a quaternary ammonium ester softening active. Methods of making and using such compositions.

10 Claims, No Drawings

(56) References Cited

OTHER PUBLICATIONS

Extended European Search Report; Application No. 18189057.5-1106; dated Apr. 3, 2019; 7 pages.
Sekisui; the Optical Brightener Carrier of Choice in Paper/ Paperboard Coatings; https://www.sekisui-sc.com/wp-content/uploads/SelvolPVOH_OBCarrier_EN.pdf; downloaded Jul. 29, 2019.
All Office Actions, U.S. Appl. No. 16/535,101.
All Office Actions, U.S. Appl. No. 16/535,103.
International Search Report and Written Opinion; Application Ser. No. PCT/US2019/046470 dated Sep. 20, 2019; 7 pages.
Extended EP Search Report and Written Opinion for 21161112.4-1105 dated Apr. 19, 2021, 6 pages.
OECD SIDS—Fluorescent Brightener FWA-1, pp. 1 to 11 (2005).
Sekisui "Selvol" Safety Data Sheet, Sep. 16, 2011.
"Tinopal® CBS-X" Technical Data Sheet, BASF, Mar. 2011.
All Office Actions; U.S. Appl. No. 17/692,233, filed Mar. 11, 2022.
Unpublished U.S. Appl. No. 17/692,233, filed on Mar. 11, 2022, to first inventor Johan (NMN) Smets et al.

* cited by examiner

LIQUID FABRIC TREATMENT COMPOSITIONS COMPRISING BRIGHTENER

FIELD OF INVENTION

The present disclosure relates to fabric treatment compositions comprising benefit agent capsules and brightener, and methods for making and using same.

BACKGROUND OF THE INVENTION

Liquid fabric treatment compositions used in the laundry process provide benefits to fabrics delivered by benefit agents. One example of such benefit is maintenance of the vivid appearance provided by brighteners. Other examples include softness (provided by softening actives) and a pleasant smell provided by perfumes. A problem in the field is that much of the benefit agents, in particular perfume, is either not deposited or rinsed away during fabric treatment. Because perfumes and other benefit agents are expensive components, encapsulation can be used in order to improve the delivery of the benefit agent during use. Benefit agent capsules typically contain the benefit agent until the capsule is fractured during use, thereby releasing the benefit agent. As such, upon fracturing of benefit agent capsules containing perfume, the perfume release provides freshness benefits.

It remains a challenge, however, to deposit benefit agent capsules effectively on treated fabrics, especially if the benefit agent capsules are contained in a dilute fabric treatment composition that is used to treat the fabrics. Deposition aids have been previously identified to improve the deposition of benefit agent capsules. However, the addition of depositions aids to fabric treatment compositions complicates the production process as it requires additional storage tanks and pumps and as such requires incremental cost.

Therefore, there remains a need to provide a composition to improve the deposition of benefit agent capsules on fabrics to enhance the delivery of benefit agents to provide longer lasting benefits during and after use of the liquid fabric treatment composition whilst minimizing cost and formulation complexity. The Applicant discovered that some or all of the above-mentioned needs can be at least partially fulfilled through the improved composition as described herein below.

WO2016049456 A1 relates to capsule aggregates contain two or more benefit particles each containing an active material and a polymeric material that immobilizes the active material; one or more binder polymers each having an anionic chemical group that is negatively charged or capable of being negatively charged; and one or more deposition polymers each having a cationic chemical group that is positively charged or capable of being positively charged. WO201701385 relates to benefit agent capsules coated by a particular mixture of copolymers. US20170189283 A1 relates to a microcapsule composition containing benefit agent capsules coated with a deposition protein, e.g., a protein-silanol copolymer, a protein-silane copolymer, a protein-siloxane copolymer, or a cationically modified protein.

SUMMARY OF THE INVENTION

The present disclosure relates to fabric treatment compositions comprising benefit agent capsules, brightener selected from the list consisting of diaminostilbene brighteners, biphenyl brighteners, and mixtures thereof; and quaternary ammonium ester softening active, wherein the benefit agent capsules comprise a shell material wherein said shell material is derived from polyvinylalcohol and a shell component wherein said shell component is selected from the list consisting of polyacrylate, polyamine, melamine formaldehyde, polyurea, polyurethane, polysaccharide, modified polysaccharide, urea crosslinked with formaldehyde, urea crosslinked with glutaraldehyde, siliconedioxide, sodium silicate, polyester, polyacrylamide, and mixtures thereof; said core material comprises a benefit agent.

The present disclosure further relates to a method for making and using such a fabric treatment composition.

One aim of the present disclosure is to improve the deposition of benefit agent capsules on fabrics, especially cotton fabrics.

Another aim of the present disclosure is to provide softness and maintenance of vivid colors to treated fabrics.

DETAILED DESCRIPTION OF THE INVENTION

Definitions

As used herein, the term "fabric treatment composition" is a subset of cleaning and treatment compositions that includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; liquid cleaning and disinfecting agents, fabric conditioning products including softening and/or freshening that may be in liquid, solid and/or dryer sheet form; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists. All of such products which are applicable may be in standard, concentrated or even highly concentrated form even to the extent that such products may in certain aspect be non-aqueous.

As used herein, articles such as "a" and "an" when used in a claim, are understood to mean one or more of what is claimed or described.

As used herein, the terms "include", "includes" and "including" are meant to be non-limiting.

As used herein, the term "solid" includes granular, powder, bar, lentils, beads and tablet product forms.

As used herein, the term "fluid" includes liquid, gel, paste, slurry and gas product forms.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Fabric Treatment Composition

The liquid fabric treatment composition according to the present disclosure comprises, by weight of the fabric treatment composition, 0.1 to 200 ppm of benefit agent capsules wherein the benefit agent capsules comprise a shell material encapsulating a core material, wherein said shell material is derived from polyvinylalcohol and a shell component wherein said shell component is selected from the list consisting of polyacrylate, polyamine, melamine formaldehyde, polyurea, polyurethane, polysaccharide, modified polysaccharide, urea crosslinked with formaldehyde, urea crosslinked with glutaraldehyde, siliconedioxide, sodium silicate, polyester, polyacrylamide, and mixtures thereof; said core material comprises a benefit agent; 0.1 to 50 ppm of a brightener selected from the list consisting of diaminostilbene brighteners, biphenyl brighteners, and mixtures thereof; and 10 to 2000 ppm of a quaternary ammonium ester softening active.

Brightener

The liquid fabric treatment composition comprises 0.1 to 50 ppm of a brightener selected from the list consisting of diaminostilbene brighteners, biphenyl brighteners, and mixtures thereof. It was surprisingly found that said brighteners, provide improved deposition of benefit agent capsules wherein the benefit agent capsules comprise a shell material encapsulating a core material, wherein said shell material is derived from polyvinylalcohol and a shell component. Without wishing to be bound by theory, it is believed that the deposition of benefit agent capsules is improved through the interaction between polyvinylalcohol and the brightener and the quaternary ammonium ester softening active according to the present invention.

In preferred liquid fabric treatment compositions, the brightener is selected from the list consisting of

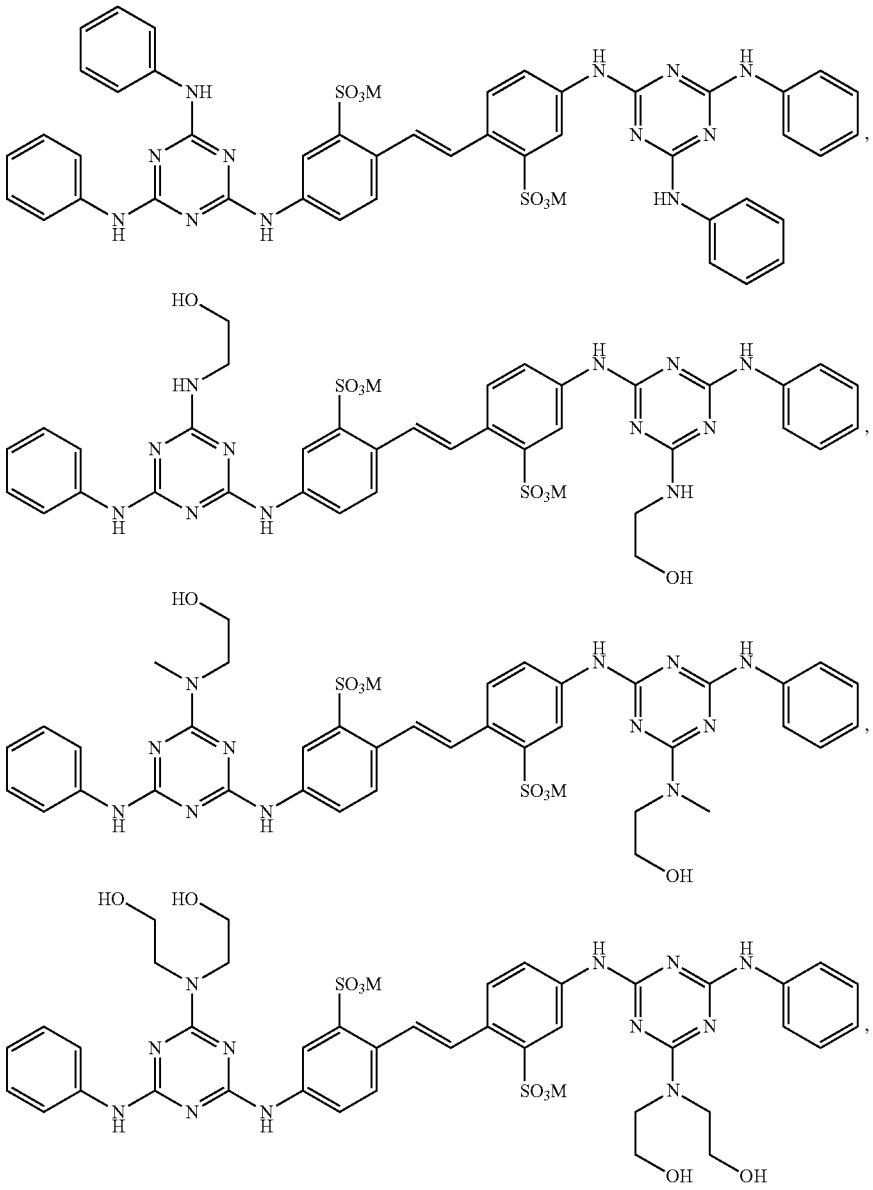

-continued
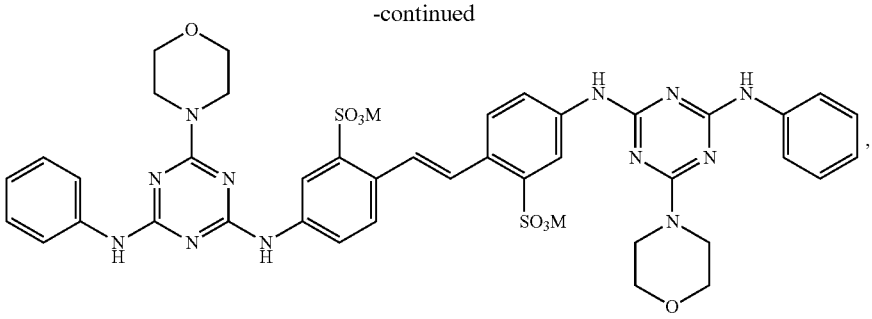
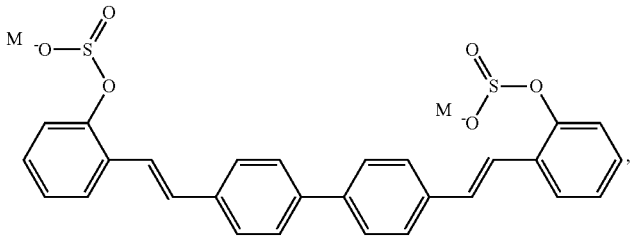
and mixtures thereof, wherein M is a suitable cation, preferably M is $H^+$ or $Na^+$, more preferably M is $Na^+$; preferably said brightener is selected from the list consisting of
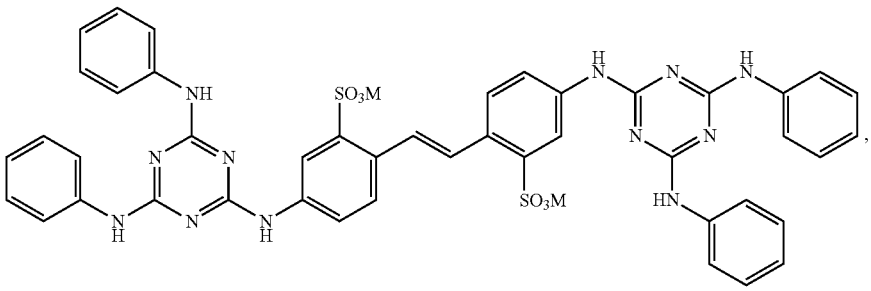
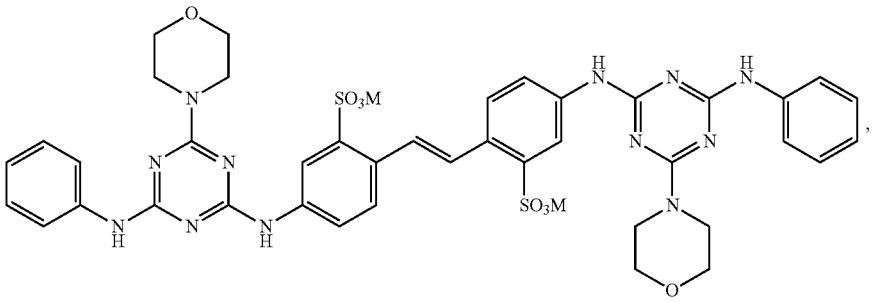
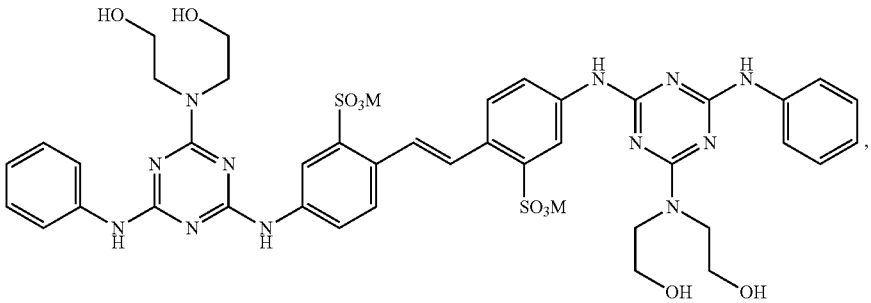

-continued

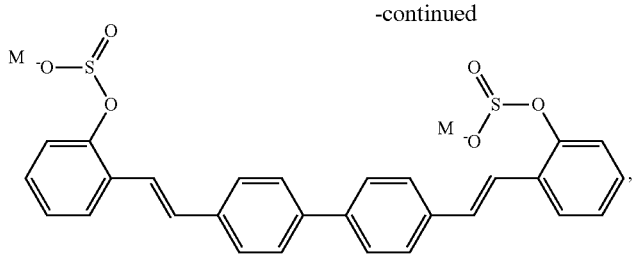

and mixtures thereof;

more preferably the brighter is

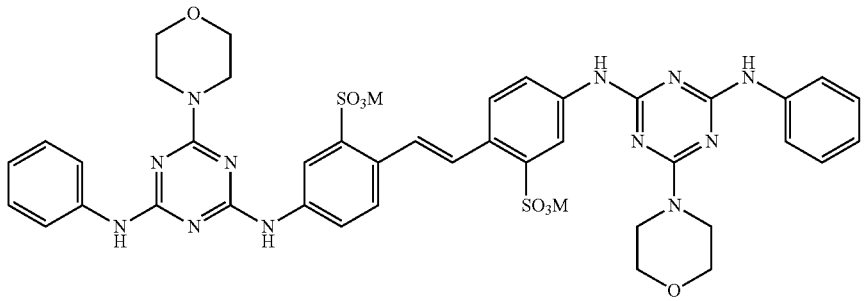

and/or

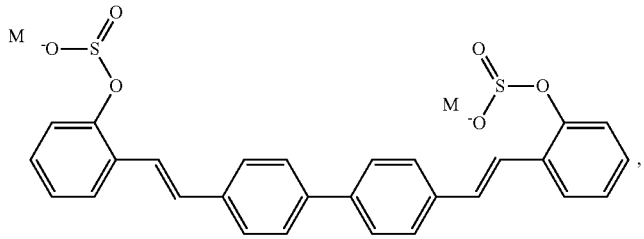

most preferably said brightener is

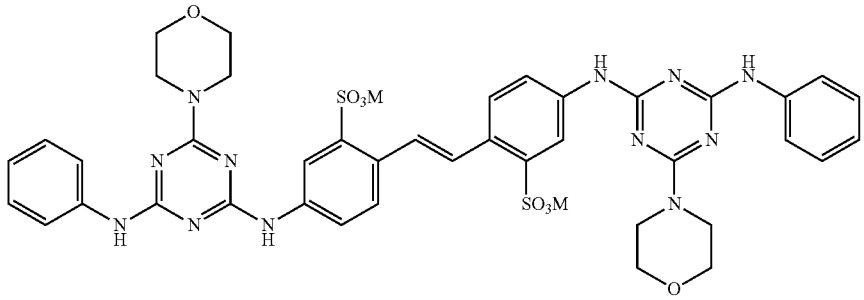

Examples of suitable diaminostilbene brighteners can be supplied under the tradename Tinopal® DMA-X, Tinopal® AMS-GX, Tinopal® DMA-X Conc, Tinopal® AMS Slurry 43, Tinopal® 5BM-GX supplied by BASF, Optiblanc supplied by 3V Sigma, and Megawhite DMX-C, supplied by Meghmani Examples of suitable biphenyl brighteners can be supplied under the tradename Tinopal® CBS, supplied by BASF, and Keyfluor™ White ML, supplied by Milliken.

In preferred fabric treatment compositions, less than 1%, more preferably less than 0.01%, of the total amount of brightener, according to the present invention, in the fabric treatment composition is encapsulated in the benefit agent capsules. Non-encapsulated brightener provides a vivid appearance and improved benefit agent capsule deposition to treated fabrics.

In preferred fabric treatment compositions, the total level of brightener is from 0.5 to 30 ppm, preferably from 1 to 20 ppm, more preferably from 1 to 10 ppm, most preferably from 1 to 5 ppm by weight of the fabric treatment composition.

In preferred fabric treatment compositions, the ratio of brightener to benefit agent capsules is from 50/1 to 1/500, more preferably from 10/1 to 1/250 most preferably from 5/1 to 1/100.

Benefit Agent Capsules

The liquid fabric treatment composition comprises 0.1 to 200 ppm of benefit agent capsules comprising a core material and a shell material encapsulating said core material wherein said shell material is derived from polyvinylalcohol and a shell component wherein said shell component is selected from the list consisting of polyacrylate, polyamine, melamine formaldehyde, polyurea, polyurethane, polysaccharide, modified polysaccharide, urea crosslinked with formaldehyde, urea crosslinked with glutaraldehyde, siliconedioxide, sodium silicate, polyester, polyacrylamide, and mixtures thereof.

The level of benefit agent capsules may depend on the desired total level of free and encapsulated benefit agent in the fabric treatment composition. In preferred fabric treatment compositions, the level of benefit agent capsules is from 1 to 100 ppm, preferably from 2 to 80 ppm, more preferably from 3 to 50 ppm by weight of the fabric treatment composition. With "level of benefit agent capsules" we herein mean the sum of the shell material and the core material.

In preferred compositions, said shell component is selected from the list consisting of polyacrylate, polyamine, polyurea, polyurethane, polysaccharide, modified polysaccharide, urea crosslinked with formaldehyde, urea crosslinked with glutaraldehyde, siliconedioxide, sodium silicate, polyester, polyacrylamide, and mixtures thereof; more preferably said shell component is selected from the list consisting of polyamine, polyurea, polyurethane, polyacrylate, and mixtures thereof; even more preferably said shell component is selected from polyurea, polyacrylate, and mixtures thereof; most preferably said shell component is polyacrylate.

The shell component may include from about 50% to about 100%, or from about 70% to about 100%, or from about 80% to about 100% of a polyacrylate polymer. The polyacrylate may include a polyacrylate cross linked polymer.

The shell material may include a material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof.

The shell material of the capsules may include a polymer derived from a material that comprises one or more multifunctional acrylate moieties. The multifunctional acrylate moiety may be selected from the group consisting of trifunctional acrylate, tetra-functional acrylate, penta-functional acrylate, hexa-functional acrylate, hepta-functional acrylate and mixtures thereof. The multifunctional acrylate moiety is preferably hexa-functional acrylate. The shell material may include a polyacrylate that comprises a moiety selected from the group consisting of an acrylate moiety, methacrylate moiety, amine acrylate moiety, amine methacrylate moiety, a carboxylic acid acrylate moiety, carboxylic acid methacrylate moiety and combinations thereof, preferably an amine methacrylate or carboxylic acid acrylate moiety.

The shell material may include a material that comprises one or more multifunctional acrylate and/or methacrylate moieties. The ratio of material that comprises one or more multifunctional acrylate moieties to material that comprises one or more methacrylate moieties may be from about 999:1 to about 6:4, preferably from about 99:1 to about 8:1, more preferably from about 99:1 to about 8.5:1.

In one aspect, the shell component is polyurea or polyurethane. Capsules wherein the shell component is derived from polyurea or polyurethane can be prepared using one or more polyisocyanates and one or more cross-linker agents.

A polyisocyanate is a molecule having two or more isocyanate groups, i.e., O═C═N—, wherein said polyisocyanate can be aromatic, aliphatic, linear, branched, or cyclic. In certain embodiments, the polyisocyanate contains, on average, 2 to 4 —N═C═O groups. In particular embodiments, the polyisocyanate contains at least three isocyanate functional groups. In certain embodiments, the polyisocyanate is water-insoluble.

The polyisocyanate can be an aromatic or aliphatic polyisocyanate. Desirable aromatic polyisocyanates each have a phenyl, tolyl, xylyl, naphthyl or diphenyl moiety or a combination thereof as the aromatic component. In certain embodiments, the aromatic polyisocyanate is a polymeric methylene diphenyl diisocyanate ("PMDI"), a polyisocyanurate of toluene diisocyanate, a trimethylol propane-adduct of toluene diisocyanate or a trimethylol propane-adduct of xylylene diisocyanate.

Suitable aliphatic polyisocyanates include trimers of hexamethylene diisocyanate, trimers of isophorone diisocyanate or biurets of hexamethylene diisocyanate. Additional examples include those commercially available, e.g., BAYHYDUR N304 and BAYHYDUR N305, which are aliphatic water-dispersible polyisocyanates based on hexamethylene diisocyanate; DESMODUR N3600, DESMODUR N3700, and DESMODUR N3900, which are low viscosity, polyfunctional aliphatic polyisocyanates based on hexamethylene diisocyanate; and DESMODUR 3600 and DESMODUR N100 which are aliphatic polyisocyanates based on hexamethylene diisocyanate, each of which is available from Bayer Corporation (Pittsburgh, Pa.).

Specific examples of wall monomer polyisocyanates include 1,5-naphthylene diisocyanate, 4,4'-diphenylmethane diisocyanate (MDI), hydrogenated MDI (H12MDI), xylylene diisocyanate (XDI), tetramethylxylol diisocyanate (TMXDI), 4,4'-diphenyldimethylmethane diisocyanate, di- and tetraalkyldiphenylmethane diisocyanate, 4,4'-dibenzyl diisocyanate, 1,3-phenylene diisocyanate, 1,4-phenylene diisocyanate, the isomers of tolylene diisocyanate (TDI), optionally in a mixture, 1-methyl-2,4-diisocyanatocyclohexane, 1,6-diisocyanato-2,2,4-trimethylhexane, 1,6-diisocyanato-2,4,4-trimethylhexane, 1-isocyanatomethyl-3-isocyanato-1,5,5-trimethylcyclohexane, chlorinated and brominated diisocyanates, phosphorus-containing diisocyanates, 4,4'-diisocyanatophenylperfluoroethane, tetramethoxybutane 1,4-diisocyanate, butane 1,4-diisocyanate, hexane 1,6-diisocyanate (HDI), dicyclohexylmethane diisocyanate, cyclohexane 1,4-diisocyanate, ethylene diisocyanate, phthalic acid bisisocyanatoethyl ester, also polyisocyanates with reactive halogen atoms, such as 1-chloromethylphenyl 2,4-diisocyanate, 1-bromomethylphenyl 2,6-diisocyanate, 3,3-bischloromethyl ether 4,4'-diphenyldiisocyanate.

Other suitable commercially-available polyisocyanates include LUPRANATE M20 (PMDI, commercially available from BASF containing isocyanate group "NCO" 31.5 wt %), where the average n is 0.7; PAPI 27 (PMDI commercially available from Dow Chemical having an average molecular weight of 340 and containing NCO 31.4 wt %) where the average n is 0.7; MONDUR MR (PMDI containing NCO at 31 wt % or greater, commercially available from Bayer) where the average n is 0.8; MONDUR MR Light (PMDI containing NCO 31.8 wt %, commercially available from Bayer) where the average n is 0.8; MONDUR 489 (PMDI commercially available from Bayer containing NCO 30-31.4 wt %) where the average n is 1.0; poly [(phenylisocyanate)-co-formaldehyde] (Aldrich Chemical, Milwaukee, Wis.), other isocyanate monomers such as DESMODUR N3200 (poly(hexamethylene diisocyanate) commercially available from Bayer), and TAKENATE D110-N(xylene diisocyanate adduct polymer commercially available from Mitsui Chemicals corporation, Rye Brook, N.Y., containing NCO 11.5 wt %), DESMODUR L75 (a polyisocyanate base on toluene diisocyanate commercially available from Bayer), DESMODUR IL (another polyisocyanate based on toluene diisocyanate commercially available from Bayer), and DESMODUR RC (a polyisocyanurate of toluene diisocyanate).

The average molecular weight of certain suitable polyisocyanates varies from 250 to 1000 Da and preferable from 275 to 500 Da. In general, the range of the polyisocyanate concentration varies from 0.1% to 10%, preferably from 0.1% to 8%, more preferably from 0.2 to 5%, and even more preferably from 1.5% to 3.5%, all based on the weight of the capsule delivery system.

Cross-linkers or cross-linking agents suitable for use with polyisocyanates each contain multiple (i.e., two or more) functional groups (e.g., —NH—, —NH2 and —OH) that can react with polyisocyanates to form polyureas or polyurethanes. Examples include polyfunctional amines containing two or more amine groups (e.g., polyamines), polyfunctional alcohols containing two or more hydroxyl groups (e.g., polyols), epoxy cross-linkers, acrylate crosslinkers, and hybrid cross-linking agents containing one or more amine groups and one or more hydroxyl groups.

Amine groups in the cross-linking agents include —NH2 and R*NH, R* being substituted and unsubstituted $C_1$-$C_{20}$ alkyl, $C_1$-$C_{20}$ heteroalkyl, $C_1$-$C_{20}$ cycloalkyl, 3- to 8-membered heterocycloalkyl, aryl, and heteroaryl.

Two classes of such polyamines include polyalkylene polyamines having the following structures:

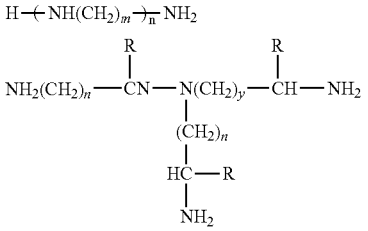

in which R is hydrogen or —$CH_3$; and m, n, x, y, and z each are independently integers from 0-2000 (e.g., 1, 2, 3, 4 or 5).

Examples include ethylene diamine, 1,3-diaminepropane, diethylene triamine, triethylene tetramine, 1,4-diaminobutane, hexaethylene diamine, hexamethylene diamine, pentaethylenehexamine, melamine and the like.

Another class of polyamines are polyalykylene polyamines of the type:

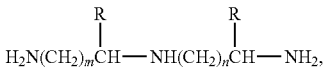

where R equals hydrogen or —$CH_3$, m is 1-5 and n is 1-5, e.g., diethylene triamine, triethylene tetraamine and the like.

Exemplary amines of this type also include diethylenetriamine, bis(3-aminopropyl)amine, bis(3-aminopropyl)-ethylenediamine, bis(hexanethylene)triamine.

Another class of amine that can be used in the invention is polyetheramines They contain primary amino groups attached to the end of a polyether backbone. The polyether backbone is normally based on either propylene oxide (P0), ethylene oxide (EO), or mixed P0/EQ. The ether amine can be monoamine, diamine, or triamine, based on this core structure. An example is:

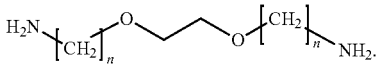

Exemplary polyetheramines include 2,2-(ethylenedioxy)-bis (ethylamine) and 4,7,10-trioxa-1, 13-tridecanediamine.

Other suitable amines include, but are not limited to, tris(2-aminoethyl)amine, triethylenetetramine, N,N'-bis (3-aminopropyl)-1,3-propanediamine, tetraethylene pentamine, 1,2-diaminopropane, 1,2-diaminoethane, N,N,N',N'-tetrakis(2-hydroxyethyl) ethylene diamine, N,N,N',N'-tetrakis(2-hydroxypropyl)ethylene diamine, N,N, N',N'-tetrakis (3-aminopropyl)-1,4-butanediamine, 3,5-diamino-1,2,4-triazole, branched polyethylenimine, 2,4-diamino-6-hydroxypyrimidine and 2,4,6-triaminopyrimidine.

Branched polyethylenimines useful as cross-linking agents typically have a molecular weight of 200 to 2,000,000 Da (e.g., 800 to 2,000,000 Da, 2,000 to 1,000,000 Da, 10,000 to 200,000 Da, and 20,000 to 100,000 Da).

Amphoteric amines, i.e., amines that can react as an acid as well as a base, are another class of amines of use in this invention. Examples of amphoteric amines include proteins and amino acids such as gelatin, L-lysine, D-lysine, L-arginine, D-arginine, L-lysine monohydrochloride, D-lysine monohydrochloride, L-arginine monohydro chloride, D-arginine monohydro chloride, L-omithine monohydrochloride, D-omithine monohydrochioride or a mixture thereof.

Guanidine amines and guanidine salts are yet another class of multi-functional amines of use in this invention. Exemplary guanidine amines and guanidine salts include, but are not limited to, 1,3-diaminoguanidine monohydrochloride, 1,1-dimethylbiguanide hydrochloride, guanidine carbonate and guanidine hydrochloride.

Commercially available examples of amines include JEFFAMINE EDR-148 having a structure shown above (where n=2), JEFFAMINE EDR-176 (where n=3) (from Huntsman). Other polyether amines include the JEFFAMINE ED Series, JEFFAMINE TRIAMINES, polyethylenimines from BASF (Ludwigshafen, Germany) under LUPASOL grades (e.g., LUPASOL FG, LUPASOL G20 waterfree, LUPASOL PR 8515, LUPASOL WF, LUPASOL FC, LUPASOL G20, LUPASOL G35, LUPASOL G100, LUPASOL G500, LUPASOL HF, LUPASOL PS, LUPASOL HEO 1, LUPASOL PNSO, LUPASOL PN6 O, LUPASOL P0100 and LUPASOL SK). Other commercially available polyethylenimines include EPOMIN P-1000, EPOMIN P-1050, EPOMIN RP18W and EPOMIN PP-061 from NIPPON SHOKUBAI (New York, Ny). Polyvinylamines such as those sold by BASF under LUPAMINE grades can also be used. A wide range of polyetheramines may be selected by those skilled in the art. In certain embodiments, the cross-linking agent is hexamethylene diamine, polyetheramine or a mixture thereof.

The range of polyfunctional amines, polyfunctional alcohols, or hybrid cross-linking agents can vary from 0.1% to 10% (e.g., 0.2% to 3%, 0.2% to 2%, 0.5% to 2%, or 0.5% to 1%) by weight of the capsule delivery system.

The capsules may comprise an emulsifier, wherein the emulsifier is preferably selected from anionic emulsifiers, nonionic emulsifiers, cationic emulsifiers or mixtures thereof, preferably nonionic emulsifiers.

The shell material of the capsules is derived from polyvinylalcohol, preferably at a level of from 0.01 to 20%, more preferably from 0.05 to 10%, even more preferably from 0.1 to 5%, most preferably from 0.1 to 2% by weight of the capsules. The polyvinylalcohol can partially reside within the shell of the capsules and can partially reside onto the outer surface of the shell. Preferably, the polyvinylalcohol has at least one the following properties, or a mixture thereof:

(i) a hydrolysis degree from 70% to 99%, preferably 75% to 98%, more preferably from 80% to 96%, more preferably from 82% to 96%, most preferably from 86% to 94%;

(ii) a viscosity of from 2 mPa·s to 150 mPa·s, preferably from 3 mPa·s to 70 mPa·s, more preferably from 4 mPa·s to 60 mPa·s, even more preferably from 5 mPa·s to 55 mPa·s in 4% water solution at 20° C.

In preferred fabric treatment compositions, the weight ratio of polyvinylalcohol to brightener is from 1/1 to 1/5000, preferably from 1/2 to 1/2000, more preferably from 1/5 to 1/1000, most preferably from 1/10 to 1/500.

Suitable polyvinylalcohol materials may be selected from Selvol 540 PVA (Sekisui Specialty Chemicals, Dallas, Tex.), Mowiol 18-88=Poval 18-88, Mowiol 3-83, Mowiol 4-98=Poval 4-98 (Kuraray), Poval KL-506=Poval 6-77 KL (Kuraray), Poval R-1130=Poval 25-98 R (Kuraray), Gohsenx K-434 (Nippon Gohsei).

Perfume compositions are the preferred encapsulated benefit agent which improve the smell of fabrics treated with the fabric treatment compositions. The perfume composition comprises perfume raw materials. The encapsulated benefit agent may further comprise essential oils, malodour reducing agents, odour controlling agents, silicone, and combinations thereof.

The perfume raw materials are typically present in an amount of from 10% to 99%, preferably from 20% to 98%, more preferably from 70% to 96%, by weight of the capsule.

The perfume composition may comprise from 2.5% to 30%, preferably from 5% to 30% by weight of perfume composition of perfume raw materials characterized by a log P lower than 3.0, and a boiling point lower than 250° C.

The perfume composition may comprise from 5% to 30%, preferably from 7% to 25% by weight of perfume composition of perfume raw materials characterized by having a log P lower than 3.0 and a boiling point higher than 250° C. The perfume composition may comprise from 35% to 60%, preferably from 40% to 55% by weight of perfume composition of perfume raw materials characterized by having a log P higher than 3.0 and a boiling point lower than 250° C. The perfume composition may comprise from 10% to 45%, preferably from 12% to 40% by weight of perfume composition of perfume raw materials characterized by having a log P higher than 3.0 and a boiling point higher than 250° C.

Preferably, the core also comprises a partitioning modifier. Suitable partitioning modifiers include vegetable oil, modified vegetable oil, propan-2-yl tetradecanoate and mixtures thereof. The modified vegetable oil may be esterified and/or brominated. The vegetable oil comprises castor oil and/or soy bean oil. The partitioning modifier may be propan-2-yl tetradecanoate. The partitioning modifier may be present in the core at a level, based on total core weight, of greater than 10%, or from greater than 10% to about 80%, or from greater than 20% to about 70%, or from greater than 20% to about 60%, or from about 30% to about 60%, or from about 30% to about 50%.

Preferably the capsules have a volume weighted mean particle size from 0.5 microns to 100 microns, preferably from 1 micron to 60 microns, even more preferably from 5 microns to 45 microns.

For example, polyacrylate benefit agent capsules can be purchased from Encapsys, (825 East Wisconsin Ave, Appleton, Wis. 54911), and can be made as follows with for example perfume as benefit agent: a first oil phase, consisting of 37.5 g perfume, 0.2 g tert-butylamino ethyl methacrylate, and 0.2 g beta hydroxyethyl acrylate is mixed for about 1 hour before the addition of 18 g CN975 (Sartomer, Exter, Pa.). The solution is allowed to mix until needed later in the process.

A second oil phase consisting of 65 g of the perfume oil, 84 g isopropyl myristate, 1 g 2,2'-azobis(2-methylbutyronitrile), and 0.8 g 4,4'-azobis[4-cyanovaleric acid] is added to a jacketed steel reactor. The reactor is held at 35° C. and the oil solution in mixed at 500 rpm with a 2" flat blade mixer. A nitrogen blanket is applied to the reactor at a rate of 300 cc/min. The solution is heated to 70° C. in 45 minutes and held at 70° C. for 45 minutes, before cooling to 50° C. in 75 minutes. At 50° C., the first oil phase is added and the combined oils are mixed for another 10 minutes at 50° C.

A water phase, containing 85 g Selvol 540 PVA (Sekisui Specialty Chemicals, Dallas, Tex.) at 5% solids, 268 g water, 1.2 g 4,4'-azobis[4-cyanovaleric acid], and 1.1 g 21.5% NaOH, is prepared and mixed until the 4,4'-AZOBIS[4-CYANOVALERIC ACID] dissolves.

Once the oil phase temperature has decreased to 50° C., mixing is stopped and the water phase is added to the mixed oils. High shear agitation is applied to produce an emulsion with the desired size characteristics (1900 rpm for 60 minutes.)

The temperature is increased to 75° C. in 30 minutes, held at 75° C. for 4 hours, increased to 95° C. in 30 minutes, and held at 95° C. for 6 hours.

The Quaternary Ammonium Ester Softening Active

The liquid fabric treatment composition of the present invention comprises from 10 to 2000 ppm, preferably from 20 to 1000 ppm, more preferably from 50 to 500 ppm, most preferably from 100 to 400 ppm of a quaternary ammonium ester softening active (Fabric Softening Active, "FSA"). The level of quaternary ammonium ester softening active may depend of the desired concentration of total softening active and of the presence or not of other softening actives.

Without wishing to be bound by theory, Applicants believe that the deposition of benefit agent capsules, especially the affinity for cotton fabrics, is improved by the, at least partial, coating of the benefit agent capsules.

Preferably, the iodine value of the parent fatty acid from which the quaternary ammonium fabric softening active is formed is from 5 to 60, more preferably from 10 to 45, even more preferably from 15 to 40. Without being bound by theory, lower melting points resulting in easier processability of the FSA are obtained when the parent fatty acid from which the quaternary ammonium fabric softening active is formed is at least partially unsaturated. Especially double unsaturated fatty acids enable easy to process FSA's.

Suitable quaternary ammonium ester softening actives include but are not limited to, materials selected from the group consisting of monoester quats, diester quats, triester quats and mixtures thereof. Preferably, the level of monoester quat is from 2.0% to 40.0%, the level of diester quat is from 40.0% to 98.0%, the level of triester quat is from 0.0% to 25.0% by weight of total quaternary ammonium ester softening active.

Said quaternary ammonium ester softening active may comprise compounds of the following formula:

$$\{R^2_{(4-m)}—N^+—[X—Y—R^1]_m\}A^-$$

wherein:

m is 1, 2 or 3 with the proviso that the value of each m is identical;

each $R^1$ is independently hydrocarbyl, or branched hydrocarbyl group, preferably $R^1$ is linear, more preferably $R^1$ is partially unsaturated linear alkyl chain;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_{2-3}$ alkoxy), polyethoxy, benzyl;

each X is independently —$(CH_2)_n$—, —$CH_2$—CH($CH_3$)— or —CH($CH_3$)—$CH_2$— and each n is independently 1, 2, 3 or 4, preferably each n is 2;

each Y is independently —O—(O)C— or —C(O)—O—;

A- is independently selected from the group consisting of chloride, methyl sulfate, and ethyl sulfate, preferably A- is selected from the group consisting of chloride and methyl sulfate;

with the proviso that when Y is —O—(O)C—, the sum of carbons in each $R^1$ is from 11 to 21, preferably from 11 to 19.

In preferred liquid fabric treatment compositions, the quaternary ammonium ester softening active comprises a fatty acid moiety comprising 12 to 22 carbons, said quaternary ammonium esters being selected from the group consisting of:

a) bis-(2-hydroxypropyl)-dimethylammonium methylsulfate fatty acid ester;

b) isomers of bis-(2-hydroxypropyl)-dimethylammonium methylsulfate fatty acid ester;

c) N,N-bis(hydroxyethyl)-N,N-dimethyl ammonium chloride fatty acid ester;

d) N,N-bis(hydroxyethyl)-N,N-dimethyl ammonium methylsulfate fatty acid ester; and e) N,N,N-tri(2-hydroxyethyl)-N-methyl ammonium methylsulfate fatty acid ester;

said quaternary ammonium ester softening active's fatty acid ester moiety being saturated or unsaturated, and substituted or unsubstituted.

Examples of suitable quaternary ammonium ester softening actives are commercially available from KAO Chemicals under the trade name Tetranyl AT-1 and Tetranyl AT-7590, from Evonik under the tradename Rewoquat WE16 DPG, Rewoquat WE18, Rewoquat WE20, Rewoquat WE28, and Rewoquat 38 DPG, from Stepan under the tradename Stepantex GA90, Stepantex VR90, Stepantex VK90, Stepantex VA90, Stepantex DC90, Stepantex VL90A.

Adjunct Materials

The fabric treatment composition can comprise additional ingredients, such as those selected from the group consisting of: polymer deposition aid, organic builder and/or chelant, enzymes, enzyme stabiliser, hueing dyes, particulate material, cleaning polymers, external structurants, and mixtures thereof.

Polymer Deposition Aid: The base mix can comprise from 0.1% to 7%, more preferably from 0.2% to 3%, of a polymer deposition aid. As used herein, "polymer deposition aid" refers to any cationic polymer or combination of cationic polymers that significantly enhance deposition of a fabric care benefit agent onto the fabric during laundering. Suitable polymer deposition aids can comprise a cationic polysaccharide and/or a copolymer. "Benefit agent" as used herein refers to any material that can provide fabric care benefits. Non-limiting examples of fabric care benefit agents include: silicone derivatives, oily sugar derivatives, dispersible polyolefins, polymer latexes, cationic surfactants and combinations thereof. Preferably, the deposition aid is a cationic or amphoteric polymer. The cationic charge density of the polymer preferably ranges from 0.05 milliequivalents/g to 6 milliequivalents/g. The charge density is calculated by dividing the number of net charge per repeating unit by the molecular weight of the repeating unit. In one embodiment, the charge density varies from 0.1 milliequivalents/g to 3 milliequivalents/g. The positive charges could be on the backbone of the polymers or the side chains of polymers.

Organic builder and/or chelant: The base mix can comprise from 0.6% to 10%, preferably from 2 to 7% by weight of one or more organic builder and/or chelants. Suitable organic builders and/or chelants are selected from the group consisting of: MEA citrate, citric acid, aminoalkylenepoly (alkylene phosphonates), alkali metal ethane 1-hydroxy disphosphonates, and nitrilotrimethylene, phosphonates, diethylene triamine penta (methylene phosphonic acid) (DTPMP), ethylene diamine tetra(methylene phosphonic acid) (DDTMP), hexamethylene diamine tetra(methylene phosphonic acid), hydroxy-ethylene 1,1 diphosphonic acid (HEDP), hydroxyethane dimethylene phosphonic acid, ethylene di-amine di-succinic acid (EDDS), ethylene diamine tetraacetic acid (EDTA), hydroxyethylethylenediamine triacetate (HEDTA), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), catechol sulfonates such as Tiron™ and mixtures thereof.

Hueing dyes: Hueing dyes, shading dyes or fabric shading or hueing agents are useful laundering adjuncts in fluid laundry detergent compositions. The history of these materials in laundering is a long one, originating with the use of "laundry blueing agents" many years ago. More recent developments include the use of sulfonated phthalocyanine dyes having a Zinc or aluminium central atom; and still more recently a great variety of other blue and/or violet dyes have been used for their hueing or shading effects. See for example WO 2009/087524 A1, WO2009/087034A1 and references therein. The fluid laundry detergent compositions herein typically comprise from 0.00003 wt % to 0.1 wt %, from 0.00008 wt % to 0.05 wt %, or even from 0.0001 wt % to 0.04 wt %, fabric hueing agent.

Particulate material: Suitable particulate materials are clays, suds suppressors, microcapsules e.g., having encapsulated ingredients such as perfumes, bleaches and enzymes in encapsulated form; or aesthetic adjuncts such as pearlescent agents, pigment particles, mica or the like. Particularly preferred particulate materials are microcapsules, especially perfume microcapsules. Microcapsules are typically formed by at least partially, preferably fully, surrounding a benefit agent with a wall material. Preferably, the microcapsule is a perfume microcapsule, where said benefit agent comprises one or more perfume raw materials. Suitable use levels are from 0.0001% to 5%, or from 0.1% to 1% by weight of the fabric treatment composition.

Perfume: Suitable perfumes are known in the art, and are typical incorporated at a level from 0.001 to 10%, preferably from 0.01% to 5%, more preferably from 0.1% to 3% by weight.

Cleaning polymers: Suitable cleaning polymers provide for broad-range soil cleaning of surfaces and fabrics and/or suspension of the soils. Any suitable cleaning polymer may be of use. Useful cleaning polymers are described in USPN 2009/0124528A1. Non-limiting examples of useful categories of cleaning polymers include: amphiphilic alkoxylated grease cleaning polymers; clay soil cleaning polymers; soil release polymers; and soil suspending polymers.

Method for Making a Liquid Fabric Treatment Composition

A method for making the liquid fabric treatment compositions according to the present invention comprises the steps:

a. providing a composition comprising a brightener selected from the list consisting of diaminostilbene brighteners, biphenyl brighteners, and mixtures thereof;

b. mixing the composition comprising a brightener of step a) with an aqueous solution to form a dilute composition comprising a brightener;

c. providing a composition comprising a quaternary ammonium ester softening active and benefit agent capsules;

d. mixing the composition comprising a quaternary ammonium ester softening active and benefit agent capsules of step c) with the dilute composition comprising a brightener of step b).

Use of a Liquid Fabric Treatment Composition

Applicants have surprisingly found that brighteners selected from the list consisting of diaminostilbene brighteners, biphenyl brighteners, and mixtures thereof, in a liquid fabric treatment composition according to the present invention provide improved deposition of benefit agent capsules. Without wishing to be bound by theory, Applicants believe that the improved deposition of benefit agent capsules, especially the affinity for cotton fabrics, is caused by the interaction between the brightener and the polyvinylalcohol of the benefit agent capsules and the quaternary ammonium ester fabric softening active, even in rather dilute liquid fabric treatment compositions.

Methods

Method to Treat Fabrics

Miniwasher Model #1001, which is a small-scale washing machine simulator having US top loader design, are used to treat fabrics. For each leg, a Miniwasher tube is loaded with 100 g of fabric, comprising 20 g knitted polyester (supplied by WFK) and 80 g knitted cotton (supplied by WFK). Also 4 non-brightened interlock cotton tracers (supplied by WFK), size 4 cm×4 cm are added for headspace analyses. In each tube 3 L city water of 40° C. and 14.7 g liquid detergent composition was added. The fabrics were treated in the Miniwasher tube during 45 minutes with this liquid detergent to mimic the main wash of a washing machine. After 45 minutes the fabrics were centrifuged for 5 minutes whilst water was spinning out. After the main wash, the fabrics were treated with a liquid fabric treatment composition comprising a quaternary ammonium ester softening active, benefit agent capsules, and brightener during 7 at 25° C. After 7 minutes, the fabrics were centrifuged again for 12 minutes. The cotton fabrics were removed and line dried during night. The next day the dry fabrics are analyzed following below method to determine headspace concentration above treated fabrics Method to Determine Headspace Concentration Above Treated Fabrics The dry non-brightened cotton tracers are analyzed by fast headspace GC/MS (gas chromatography mass spectrometry) approach. The 4×4 cm aliquots of cotton tracers were transferred to 25 ml headspace vials. The fabric samples were equilibrated for 10 minutes@ 75° C. The headspace above the fabrics was sampled via SPME (50/30 μm DVB/Carboxen/PDMS) approach for 5 minutes. The SPME fiber was subsequently on-line thermally desorbed into the GC. The analytes were analyzed by fast GC/MS in full scan mode. Ion extraction of the specific masses of the PRM's was used to calculate the total HS response and perfume headspace composition above the tested legs.

Method to Measure Viscosity of Polyvinylalcohol Solution

Viscosity is measured using a Brookfield LV series viscometer or equivalent, measured at 4.00%+/−0.05% solids.

a. Prepare a 4.00%+/−0.05% Solid Solution of Polyvinyl Alcohol.

Weigh a 500 mL beaker and stirrer. Record the weight. Add 16.00+/−0.01 grams of a polyvinyl alcohol sample to the beaker. Add approximately 350-375 mL of deionized water to the beaker and stir the solution. Place the beaker into a hot water bath with the cover plate. Agitate at moderate speed for 45 minutes to 1 hour, or until the polyvinyl alcohol is completely dissolved. Turn off the stirrer. Cool the beaker to approximately 20° C.

Calculate the final weight of the beaker as follows:

Final weight=(weight of empty beaker & stirrer)+(% solids as decimal×400)

Example: weight of empty beaker & stirrer=125.0 grams

% solids of polyvinyl alcohol (of the sample)=97.50% or 0.9750 as decimal

Final weight=125.0+(0.9750×400)=515.0 grams

Zero the top loading balance and place the beaker of polyvinyl alcohol solution with a propeller on it. Add deionized water to bring the weight up to the calculated final weight of 515.0 grams.

Solids content of the sample has to be 4.00+0.05% to measure viscosity.

b. Measure Viscosity

Dispense the sample of 4% polyvinyl alcohol solution into the chamber of the viscometer, insert the spindle and attach it to the viscometer. Sample adapter (SSA) with chamber SC4-13RPY, Ultralow adapter. The spindles are SC4-18 and 00. Allow the sample to achieve equilibration at 20° C. temperature. Start the viscometer and record the steady state viscosity value.

Report viscosity <13 cP to nearest 0.01 cP, 13-100 cP to nearest 0.1 cP; viscosities over 100 cP are reported to the nearest 1 cP.

Corrections to the measured viscosity are not necessary if the calculated solution solids content is 4.00±0.05%. Otherwise, use the following equation to correct the measured viscosity for solution solids deviations.

$$\text{Log}_e \text{ Corrected Viscosity} = \frac{(\text{Log}_e \text{ Measured Viscosity})}{(\text{percent solids}) \times (0.2060) + (0.1759)}$$

$$\text{Corrected Viscosity} = 2.718282 \text{ (Log Corrected Viscosity)}$$

EXAMPLES

Polyacrylate perfume capsules were made as follows: a first oil phase, consisting of 37.5 g perfume, 0.2 g tert-butylamino ethyl methacrylate, and 0.2 g beta hydroxyethyl acrylate was mixed for about 1 hour before the addition of 18 g CN975 (Sartomer, Exter, Pa.). The solution was allowed to mix until needed later in the process.

A second oil phase consisting of 65 g of the perfume oil, 84 g isopropyl myristate, 1 g 2,2'-azobis(2-methylbutyronitrile), and 0.8 g 4,4'-azobis[4-cyanovaleric acid] was added to a jacketed steel reactor. The reactor was held at 35° C. and the oil solution in mixed at 500 rpm with a 2" flat blade mixer. A nitrogen blanket was applied to the reactor at a rate of 300 cc/min. The solution was heated to 70° C. in 45 minutes and held at 70° C. for 45 minutes, before cooling to 50° C. in 75 minutes. At 50° C., the first oil phase was added and the combined oils were mixed for another 10 minutes at 50° C.

A water phase, containing 85 g Selvol 540 PVA (Sekisui Specialty Chemicals, Dallas, Tex.) at 5% solids, 268 g water, 1.2 g 4,4'-azobis[4-cyanovaleric acid], and 1.1 g 21.5% NaOH, was prepared and mixed until the 4,4'-AZOBIS[4-CYANOVALERIC ACID] dissolved.

Once the oil phase temperature decreased to 50° C., mixing was stopped and the water phase was added to the mixed oils. High shear agitation was applied to produce an emulsion with the desired size characteristics (1900 rpm for 60 minutes).

The temperature was increased to 75° C. in 30 minutes, held at 75° C. for 4 hours, increased to 95° C. in 30 minutes, and held at 95° C. for 6 hours.

Liquid fabric treatment composition Example 1-2 were used to treat fabrics according to the methods described in the METHODS section. The brightener 15 was added in Example 2, using a premix. The brightener 15 premix was made by mixing Brightener 15, diethylene glycol and monoethanolamine together in a plastic beaker with a blade mixer.

Brightener 15 corresponds to formula

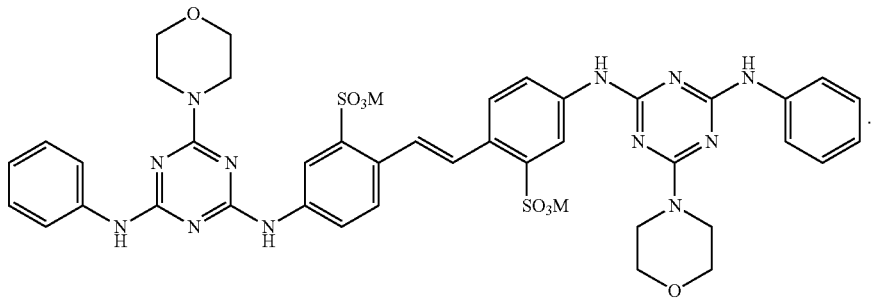

The premixes were made to enable homogeneous distribution of the brightener. The detailed composition of the fabric treatment compositions (Ex. 1-2) is provided in Table 1.

TABLE 1 compositional details of comparative example 1 and inventive example 2.

| | Ex. 1 | Ex. 2 |
|---|---|---|
| | ppm | |
| Water | Balance to 100% | |
| FSA[1] | 200 | 200 |
| Formic acid | 1.13 | 1.13 |
| HCl | 0.20 | 0.20 |
| Preservative | 0.11 | 0.11 |
| Antifoam | 0.20 | 0.20 |
| NaHEDP | 0.18 | 0.18 |
| Benefit agent capsules | 4.13 | 4.13 |
| Alkyl ether sulfate (C24 AE3S) | 2.42 | 2.42 |
| Dodecyl Benzene Sulphonic Acid | 28.49 | 28.49 |
| Ethoxylated alcohol (C24 EO7) | 5.67 | 5.67 |
| Ethoxylated alcohol (C45 EO7) | 11.51 | 11.51 |
| Fatty acid | 7.27 | 7.27 |
| Citric acid | 8.81 | 8.81 |

TABLE 1-continued compositional details of comparative example 1 and inventive example 2.

| | Ex. 1 | Ex. 2 |
|---|---|---|
| | ppm | |
| Sodium Diethylene triamine penta methylene phosphonic acid | 1.26 | 1.26 |
| enzyme | 0.07 | 0.07 |
| $CaCl_2$ | 0.01 | 0.01 |
| sodium formate | 0.03 | 0.03 |
| Ethoxysulfated hexamethylene diamine quaternized | 1.77 | 1.77 |
| co-polymer of Polyethylene glycol and vinyl acetate | 3.00 | 3.00 |
| Brightener 15 | — | 2.81 |
| ethanol | 2.77 | 2.77 |
| 1,2-propanediol | 3.17 | 3.17 |
| sodium cumenesulphonate | 1.28 | 1.28 |
| mono ethanolamine | 0.63 | 0.63 |
| NaOH | 10.05 | 10.05 |
| hydrogenated castor oil | 0.79 | 0.79 |
| Silicone | 0.01 | 0.01 |
| Dye | 0.02 | 0.02 |
| Dry headspace [nmol/L] | 129 | 154 |

[1]N,N-bis(hydroxyethyl)-N,N-dimethyl ammonium chloride fatty acid ester. The iodine value of the parent fatty acid of this material is about 20. The material as obtained from Evonik contains impurities in the form of free fatty acid, the monoester form of N,N-bis(hydroxyethyl)-N,N-dimethyl ammonium chloride fatty acid ester, and fatty acid esters of N,N-bis(hydroxyethyl)-N-methylamine.

The headspace above dry treated cotton fabrics showed an increase from 129 nmol/L to 154 nmol/L. This increase was determined to be significant at a 90% confidence level, using a Student's t-test.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid fabric treatment composition comprising by weight of the composition of:

a) about 0.1 to about 200 ppm of benefit agent capsules wherein the benefit agent capsules comprise a shell material encapsulating a core material, wherein said shell material is derived from polyvinylalcohol and a shell component wherein said shell component is polyacrylate; said core material comprises perfume raw materials, wherein the perfume raw materials are present in an amount of from 20% to 98% by weight of the benefit agent capsules;

b) about 0.1 to about 50 ppm of a brightener wherein said brightener is

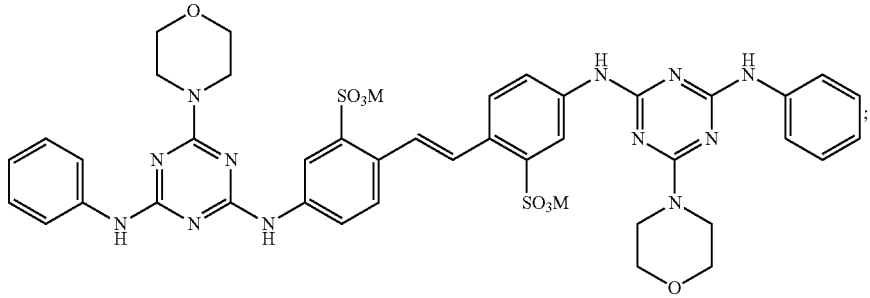

and c) about 10 to about 2000 ppm of a quaternary ammonium ester softening active.

2. The liquid fabric treatment composition according to claim 1 wherein the level of polyvinylalcohol is from about 0.01 to about 20% by weight of the benefit agent capsules.

3. The liquid fabric treatment composition according to claim 1 wherein the level of brightener is from about 0.5 to about 30 ppm by weight of the fabric treatment composition.

4. The liquid fabric treatment composition according to claim 1 wherein the polyvinylalcohol has a degree of hydrolysis of about 70% to about 99%.

5. The liquid fabric treatment composition according to claim 1 wherein the polyvinylalcohol as a 4 wt % solution in water has a viscosity of from about 2 mPa·s to about 150 mPa·s.

6. The liquid fabric treatment composition according to claim 1 wherein the weight ratio of polyvinylalcohol to brightener is from about 1/1 to about 1/5000.

7. The liquid fabric treatment composition according to claim 1 wherein the ratio of brightener to benefit agent capsules is from about 50/1 to about 1/500.

8. The liquid fabric treatment composition according to claim 1 wherein said quaternary ammonium ester softening active has the following formula:

$$\{R^2_{(4-m)}—N^+—[X—Y—R^1]_m\}A^-$$

wherein:

m is 1, 2 or 3 with proviso that the value of each m is identical;

each $R^1$ is independently hydrocarbyl, or substituted hydrocarbyl group;

each $R^2$ is independently a $C_1$-$C_3$ alkyl or hydroxyalkyl group;

each X is independently $(CH_2)n$, $CH_2$—$CH(CH_3)$— or CH—$(CH_3)$—$CH_2$— and each n is independently 1, 2, 3 or 4;

each Y is independently —O—(0)C— or —C(O)—O—;

A- is independently selected from the group consisting of chloride, methylsulfate, ethylsulfate, and sulfate; with the proviso that the sum of carbons in each $R^1$, when Y is —O—(0)C—, is from about 11 to about 21.

9. The liquid fabric treatment composition according to claim 1 wherein said quaternary ammonium ester softening active comprises a fatty acid moiety comprising about 12 to about 22 carbons, said quaternary ammonium esters being selected from the group consisting of:

a) bis-(2-hydroxypropyl)-dimethylammonium methylsulfate fatty acid ester;

b) isomers of bis-(2-hydroxypropyl)-dimethylammonium methylsulfate fatty acid ester;

c) N,N-bis(hydroxyethyl)-N,N-dimethyl ammonium chloride fatty acid ester;

d) N,N-bis(hydroxyethyl)-N,N-dimethyl ammonium methylsulfate fatty acid ester; and e) N,N,N-tri(2-hydroxyethyl)-N-methyl ammonium methylsulfate fatty acid ester;

said quaternary ammonium ester softening active's fatty acid ester moiety being saturated or unsaturated, and substituted or unsubstituted.

10. A method for making a liquid fabric treatment composition according to claim 1 comprising the following steps:

a. providing a composition comprising a brightener which is

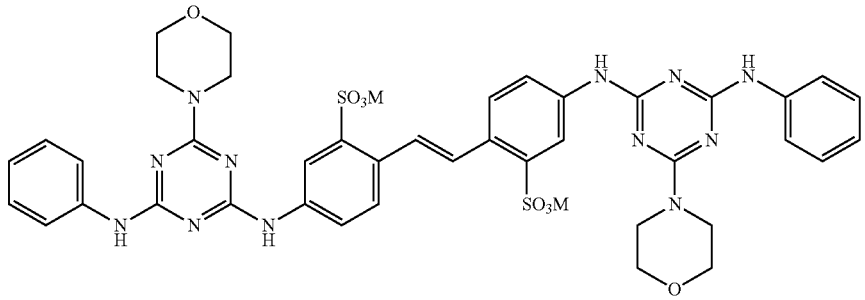

b. mixing the composition comprising the brightener of step a) with an aqueous solution to form a dilute composition comprising the brightener;

c. providing a composition comprising the quaternary ammonium ester softening active and the benefit agent capsules;

d. mixing the composition comprising the quaternary ammonium ester softening active of step c) with the dilute composition comprising the brightener of step b) to form a liquid fabric treatment composition according to claim 1.

* * * * *